US006311759B1

(12) United States Patent
Tausig et al.

(10) Patent No.: US 6,311,759 B1
(45) Date of Patent: Nov. 6, 2001

(54) SEMI-SOLID METAL PROCESSING

(75) Inventors: Gabriela Tausig, Noble Park; Kenong Xia, Mitcham, both of (AU)

(73) Assignee: The University of Melbourne, Parkville (AU)

( * ) Notice: Subject to any disclaimer, the term of this patent is extended or adjusted under 35 U.S.C. 154(b) by 0 days.

(21) Appl. No.: 09/214,643

(22) PCT Filed: Jul. 18, 1997

(86) PCT No.: PCT/AU97/00458

§ 371 Date: Jan. 8, 1999

§ 102(e) Date: Jan. 8, 1999

(87) PCT Pub. No.: WO98/03686

PCT Pub. Date: Jan. 29, 1998

(30) Foreign Application Priority Data

Jul. 18, 1996 (AU) ..... PO1102

(51) Int. Cl.[7] ..... B22D 17/00; B22D 25/00
(52) U.S. Cl. ..... 164/113; 164/900
(58) Field of Search ..... 164/315, 113, 164/476, 900; 148/549

(56) References Cited

U.S. PATENT DOCUMENTS 4,524,820 6/1985 Gullotti et al. .
4,585,494 4/1986 Ashok et al. .
4,621,676 * 11/1986 Steward ..... 164/485
4,771,818 9/1988 Kenney .
5,571,346 11/1996 Bergsma .

FOREIGN PATENT DOCUMENTS 0 701 002 3/1996 (EP) .
0 733 421 9/1996 (EP) .
WO 92/03582 3/1992 (WO) .

* cited by examiner

*Primary Examiner*—Kuang Y. Lin
(74) *Attorney, Agent, or Firm*—Christensen O'Connor Johnson Kindness PLLC

(57) ABSTRACT

A process for producing a shaped metallic article includes the steps of melting a metal alloy, reducing the temperature of the molten metal to the liquidus temperature, casting the molten metal at the liquidus temperature into a mould and solidifying the molten metal to obtain a feedstock material. The feedstock material is subsequently heated to a temperature between the liquidus and solidus temperatures to produce a self-supporting thixotropic material which is then formed to the desired shape. Casting the feedstock material from a melt at substantially the liquidus temperature produces a microstructure that is especially suitable for subsequent forming of the thixotropic material and this allows use of slower forming speeds and lower forming pressure during the forming step.

27 Claims, 5 Drawing Sheets

Alloy 2618 from liquidus casting.

Alloy 2618 from conventional casting.

Liquidus-cast 2618 after reheating.

Liquidus-cast 2618 after forming.

CLUTCH HUB: microstructure showing no flow.

CLUTCH HUB: microstructure showing flow.

SEMI-SOLID METAL PROCESSING

CROSS REFERENCE TO RELATED APPLICATIONS

This is a United States national stage of International application No. PCT/AU97/00458, filed Jul. 18, 1997, the benefit of the filing date of which is herby claimed under 35 U.S.C. §120, which in turn claims the benefit of Australian application No. PO 1102, filed Jul. 18, 1996, the benefit of the filing date of which is hereby claimed under 35 U.S.C. §119.

FIELD OF THE INVENTION

The present invention relates to a process for producing metal articles using thixoforming.

BACKGROUND OF THE INVENTION

Semisolid metal processing is generally used to refer to any processing of a metal alloy at temperatures between the solidus and liquidus temperatures of that alloy. Semisolid metal processing involves producing a thixotropic material that comprises a mixture or slurry of solid metal particles and molten (or liquid) metal and subsequently forming or shaping the thixotropic material. The term "semi-solid metal processing" conventionally encompasses both the methods of producing the thixotropic material and the subsequent forming or shaping of the thixotropic material. There are two major categories of semisolid metal forming processes that can be identified:

a) rheoprocessing, in which an alloy is fully melted by heating to a temperature above the liquidus temperature and the melt is then cooled to a temperature between the solidus and liquidus temperature to thereby produce the thixotropic material, and subsequently forming or shaping the thixotropic material. An example of rheoprocessing is rheocasting; and b) thixoforming, in which a semisolid metal processing feedstock is produced by cooling a semisolid slurry to fully solidify the metal. The feedstock is then reheated to a temperature between the solidus and liquidus temperatures to produce a thixotropic material just prior to being shaped.

Thixoforming processes are further subdivided, if rather arbitrarily, into categories according to the conventional metal shaping technologies with which they are comparable in terms of general processing and especially in terms of the actual machinery used for metal shaping. For example, thixocasting is based on liquid metal die casting technology, where as thixoforging is more akin to solid metal forging, for example, in the use of vertical forging presses in shaping of the articles. While there seems to be some difficulty in literature and the industry in drawing a clear line between thixocasting and thixoforging processes, there is a clear distinction between thixoforming and conventional metal processing (e.g. casting and forging). Thixoforming is a new development in metal shaping processes in that the metal is being shaped in its partially solid, partially liquid (i.e. semisolid) state, rather than in the fully liquid (casting) or fully solid (forging) state.

It is generally understood that a basic requirement for an alloy to be satisfactorily used in a thixoforming process is that the alloy has a globular, non-dendritic microstructure which when reheated to the partially solid/partially liquid state forms a slurry of solid globular particles of primary phase suspended in a lower melting point constituent which is the liquid component of the slurry. It is such a slurry which is subsequently thixoformed. Thixoforming has many advantages over conventional forging operations. Most of these are directly related to the excellent flow characteristics of semisolid thixotropic materials. The forming stresses are up to four orders of magnitude lower in the semisolid state for thixotropic materials. It follows that more intricately shaped components can be formed in a single step to net or near net shape. In relation to conventional forging in particular, this also means that parts can be manufactured faster with a smaller number of processing steps and using smaller presses. Thixoforming also permits the shaping of otherwise unforgeable alloys.

Considerable effort has been devoted to obtaining alloys that have a microstructure suitable for thixoforming. Production of thixoforming feedstock alloys having the desired microstructure have conventionally involved treatment of a thixotropic material by stirring either mechanically or electromagnetically. It is believed that stirring the thixotropic material alters the normally dendritic shape of the solid particles in the thixotropic material to form globular particles which remain after the alloy is allowed to solidify. Other methods for producing the desired microstructure include deforming and reheating to the recrystallisation or semisolid temperature range, direct partial remelting of castings and extrusions, grain refining plus partial remelting, and static stirring. These methods suffer from the disadvantage that they require elaborate processing or specially designed apparatus.

Brinegar et al in U.S. Pat. No. 4,832,112 describe a method of forming a fine grained equiaxed castings from molten metals to produce ingots, forging preforms and investment castings. The method described in this patent relates mainly to supbralloys used in the aerospace industry and is directed towards producing a chemically homogeneous, fine grained and sound product. The method involves melting a metal with the temperature of the molten metal being reduced to remove almost all of the superheat in the molten metal, The molten metal is placed in a mould and solidified by extracting heat from the mixture at a rate to solidify the molten metal to form the solid article and to obtain a substantially equiaxed cellular microstructure uniformly throughout the article. When used to make ingots, turbulence is induced in the molten metal prior to its introduction to the mould or while it is in the mould. U.S. Pat. No. 4,832,112 suggests that the temperature of the molten metal have, at the time of casting, a temperature that is within 20° F. (11.1° C.) above the measured melting point of the metal.

As mentioned above, the method of U.S. Pat. No. 4,832,112 is used to make investment castings, ingots or forging preforms. The patent makes no mention of thixoforming and indeed the emphasis in his patent on the fine grain size for improved forgeability and improved properties in an investment casting would teach the skilled person away from post treatment of the product of U.S. Pat. No. 4,832,112 by thixoforging as the partial remelting required in thixoforming potentially would cause coarsening of the grain size.

BRIEF SUMMARY OF THE INVENTION

It is an object of the present invention to provide an improved process for producing a solid article by semi-solid processing, such as thixoforming.

In a first aspect, the present invention provides a process for producing a solid article including the steps of melting a metal alloy to produce a molten metal, reducing the temperature of the molten metal to a temperature of from substantially the liquidus temperature to about 5° C. above the liquidus temperature, casting said molten metal at said temperature, solidifying the cast metal to produce a solidified metal, partially remelting the solidified metal by heating the solidified metal to a temperature between the solidus temperature and the liquidus temperature to produce a thixotropic material and forming the thixotropic material to a desired shape.

The present inventors have discovered that by very carefully controlling the temperature of the molten metal at casting to a temperature of from substantially the liquidus temperature to about 5° C. above the liquidus temperature, the solidified metal thus obtained is especially suitable for use in thixoforming and indeed significant and surprising advantages accrue in the subsequent thixoforming process. The present inventors have also discovered that very beneficial results are obtained if the temperature of the molten metal at casting is within the range of from the liquidus temperature to about 5° C. above the liquidus temperature and this temperature range represents a preferred embodiment of the present invention. Even more preferably, the temperature of the molten melt at casting is within the range of from the liquidus temperature to about 2° C. above the liquidus temperature, Most preferably, the molten metal is cast at the liquidus temperature.

Those skilled in the art will appreciate that control of temperature in molten metal casting requires that the temperature of the molten metal be measured and that the temperature of the molten metal be controlled. Both temperature measurement and temperature control will have a degree of uncertainty associated therewith.

Currently available techniques enable highly accurate temperature measurement to be made.

Turning to consider temperature control, it is desired to control the temperature of a pool of molten metal, which is typically held in a furnace, ladle or holding vessel. In such situations, it will be appreciated that accurate temperature control depends on several factors including the volume of metal, the furnace type and configuration, casting method and the temperature control system used.

Good temperature control can be achieved with the right temperature control and monitoring system, but would become progressively more difficult as the volume of melt to be held at precisely or within a couple of degrees of the target temperature, increases. Assuming that a reliable temperature reading is obtained, the spatial temperature distribution (temperature uniformity) within a volume of melt is best measured by a number of probes distributed throughout the volume. The number and placement of probes would depend on the desired accuracy. The probe output should be linked to furnace control which can then adjust input power to keep the melt within a specified temperature range. The ease and speed of achieving this of course depends on the furnace itself and the sensitivity and programming of its control systems. Again, the degree of accuracy achievable should be specified by equipment manufacturers, and give acceptable confidence interval.

High volume continuous type casting production tends to have quite sophisticated temperature control systems as the casting temperature is an important and sensitive variable irrespective of the actual casting temperature. It is not unusual to achieve temperature uniformity to well within and better than 5° C. if so required, in large volumes of metal.

The casting procedure will also play an important role in temperature control. The molten metal cannot be simply held in a ladle from which it is scooped out and put into moulds. The holding vessel will most likely need to be a well controlled furnace with preferably bottom pouring type arrangement, or a tilting furnace. This would ensure that the remaining metal pool is kept at the right temperature while casting proceeds.

Thus, current temperature control techniques allow the temperature of the molten metal to be controlled to the accuracy required by the present invention. In particular current techniques will allow the temperature to be set at the liquidus temperature and controlled to within 5° C. above that temperature. Indeed, the present inventors have achieved temperature control to within 2° C. of the desired temperature in the experimental work conducted in relation to the present invention.

It is also to be understood that the actual temperature control system does not form part of the present invention and that the present invention encompasses within its scope all temperature control systems that are capable of achieving the desired accuracy and control.

The lower limit of temperature range for casting is the liquidus temperature or no more than 2° C. below the liquidus temperature. It will be appreciated that it is preferred that the temperature of the molten metal is kept at or above the liquidus temperature (within the upper limits prescribed above) prior to casting to minimize or avoid solidification in the vessel containing the molten metal.

By casting the molten metal at a temperature from substantially the liquidus temperature to no more than 10° C., more preferably no more than 5° C. above the liquidus temperature to form the solidified metal, it has been surprisingly discovered that the solidified metal can be partially remelted and thixoformed and that significant benefits accrue in the thixoforming process. For example, the processing windows for the thixoforming process are larger. Tests conducted by the present inventor have shown that thixoforming can be easily conducted using high solids fraction, low die temperature and low forming speed whereas other materials would require lower solids fraction and higher forming speeds to obtain similar results. Lower forming speeds and die temperatures would ease wear and maintenance on the thixoforming equipment whilst allowing the specification of lower cost materials of construction in the thixoforming apparatus. High solids fraction may be desirable because the flow pattern formed into the final article under conditions of thixoforging at high solids content has the potential to enhance the strength of the final article.

In a preferred embodiment of the present invention, the molten metal is cast at precisely its liquidus temperature.

The solidified metal produced from casting of the molten metal and subsequent solidification is preferably in the form of a billet or ingot. The solidified metal has been found to have an as-cast microstructure that contains independent globules separated by a phase of lower melting point material (normally eutectic phase). Upon heating the solidified metal to a temperature between the solidus and liquidus temperatures, a semi-solid material or slurry comprising solid particles and molten metal alloy is obtained. Due to the morphology of the solidified metal, in having a globular primary grain structure, it is not necessary to hold the semi-solid material at the thixoforming temperature for any length of time before thixoforming the material. This was a requirement of some prior art feedstock materials in order to allow the required morphology to form in the semi-solid material.

A large number of metal alloys may be used in the process of the present invention. Examples include aluminum alloys, magnesium alloys, copper alloys, ferrous alloys, and superalloys. This list is not exhaustive. Preferred alloys for use in the present invention include those shown in Table 1:

TABLE 1

| Alloy Group/Grade | Nominal Composition/Composition Range (wt.%) |
|---|---|
| Aluminium | |
| 2014 | 4.4 Cu, 0.8 Si, 0.8 Mn, 0.5 Mg |
| 2618 | 2.3 Cu, l.6 Mg, 1.1 Fe, 1.0 Ni, 0.18 Si, 0.07 Ti |
| 6061 | 1.0 Mg, 0.6 Si, 0.30 Cu, 0.20 Cr |
| 6082 | 0.6 Mg, 1.0 Si, Cr 0.25 |
| 7075 | 5.6 Zn, 2.5 Mg, 1.6 Cu, 0.23 Cr |
| Magnesium | |
| AZ80 | 7.8–9.2 Al, 0.20–0.8 Zn, 0.12 Mn (min), 0.10 Si (max), 0.05 Cu (max), 0.005 Ni (max), 0.005 Fe (max) |
| AZ91D | 8.5–9.5 Al, 0.45–0.9 Zn, 0.15–0.40 Mg, 0.015 Cu (max), 0.020 Si (max),0.005 Fe (max), 0.005 Ni (max) |
| AZ6lA | 5.8–7.2 Al, 0.15 Mn (min), 0.40–1.5 Zn, 0.10 Si (max), 0.05 Cu (max),0.005 Ni (max), 0.005 Fe (max) |
| AM60A | 5.5–6.5 Al, 0.13 Mn (min), 0.50 Si (max),0.35 Cu (max), 0.22 Zn (max), 0.03 Ni (max) |
| Copper | |
| C36000 | 61.5 Cu, 35.5 Zn, 3 Pb |
| C84400 | 81 Cu, 9 Zn, 3 Sn, 7 Pb |
| C87800 | 82 Cu, 14 Zn, 4 Si |
| C83600 | 85 Cu, 5 Zn, 5 Sn, 5 Pb |
| Steels | |
| H13 tool | 0.32–0.45 C, 0.20–0.50 Mn, 0.80–1.2 Si, 4.75–5.50 Cr, 1.10–1.75 Mo, 0.80–1.75 V |
| 304 stainless | 0.08 C, 2 Mn, 1.0 Si, 18.0–20.0 Cr, 8.0–10.5 Ni, 0.045 P, 0.03 S |
| 316 stainless | 0.08 C, 2 Mn, 1.0 Si, 16.0–18.0 Cr, 10.0–14.0 Ni, 0.045 P, 0.03 S, 2.0–3.0 Mo |
| Titanium | |
| Ti-2.5 Cu | 2.0–3.0 Cu, Ti (remainder) |
| Ni superalloys | |
| Monel 400 | 63 Ni, 28–34 Cu, 2.5 Fe |
| Monel 401 | 40–45 Ni+Co, 2.5 Fe, Cu (remainder) |
| Monel 450 | 29–33 Ni, 1.0 Mn, 1.0 Zn, Cu (remainder) |
| Inconel 718 | 50–55 Ni, 17–21 Cr, Fe (remainder) |

The step of casting the molten metal at a temperature of from substantially the liquidus temperature to about 5° C. above the liquidus temperature may comprise casting the molten metal into a mould, preferably a steel mould, with the mould being at ambient temperature or at an elevated temperature. In another embodiment, the casting step may include continuously or semi-continuously casting the molten metal, for example, to form billet or ingot. In embodiments where continuous or semi-continuous casting is used, the casting apparatus may be supplied with molten metal from a source of molten metal held at substantially the liquidus temperature. Alternatively, a holding furnace or other source of molten metal may hold the molten metal at a temperature above the liquidus temperature and the molten metal may be cooled to substantially the liquidus temperature when or after the molten metal is transferred to the casting apparatus.

In the thixoforming step of the present invention. The thixotropic material is preferably self supporting in that it will hold its shape in the absence of applied external forces. The semi-solid or thixotropic material formed by partially remelting the solidified metal preferably contains a solids fraction of from 0.6 to 0.8, by volume. The forming speed used during thixoforming may be relatively low and the die temperature during thixoforming may also be relatively low. For example, the forming speed may fall within the range of about 0.1 m/s to about 0.2 m/s. The die temperature may fall within the range of about 150° C. to about 300° C.

The process of the present invention allows a combination of thixofonning operating parameters to be used that had conventionally been believed to be unsuitable for producing articles other than simple test components. The combination of thixoforming operating parameters that can be used in the present invention include high solid content in the semi-solid material, low forming speed and low die temperature.

BRIEF DESCRIPTION OF THE DRAWINGS

Examples of preferred embodiments of the present invention will now be described with reference to the accompanying Figures in which.

DETAILED DESCRIPTION OF THE INVENTION

Figure 1:
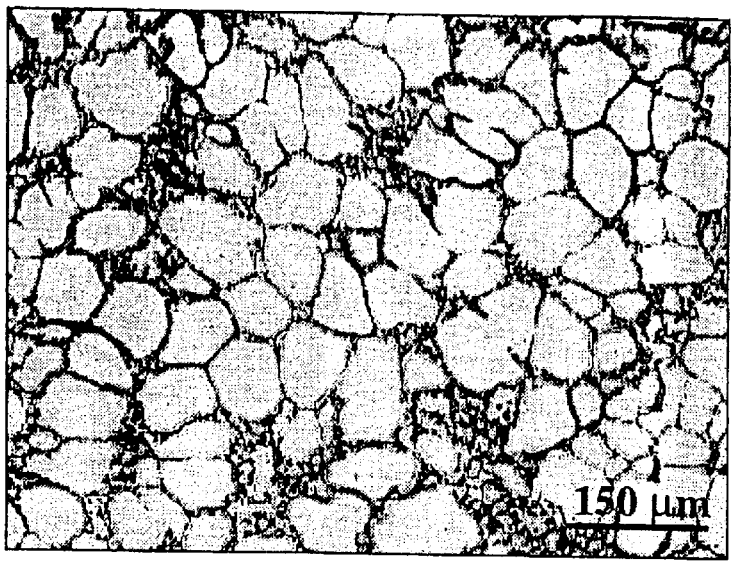
FIG. 1 shows a photomicrograph of the microstructure obtained by casting aluminum alloy 2618 from its liquidus temperature.

In order to demonstrate the advantages of the present invention, a series of experimental tests were conducted in which an aluminum alloy was heated up to a temperature above the liquidus temperature to fully melt the alloy. The molten alloy was cooled to precisely its liquidus temperature (still in the fully liquid state) and cast into a steel mould at room temperature. FIG. 1 shows a photomicrograph of the structure obtained for an aluminum alloy 2618. About 450 g of this alloy was heated to above the liquidus temperature of 638° C. and then cooled to precisely 638° C. The molten alloy was then cast into a cylindrical steel mould having an outer diameter of 120 mm and an outer length of 140 mm. The mould cavity of this mould had a diameter of 50 mm and a length of 80 mm. The mould was at ambient temperature when casting commenced.

As mentioned above, FIG. 1 shows a photomicrograph of the as cast structure obtained from this experiment. Misorientation measurements between the particles and three-dimensional imaging of the particles in FIG. 1 indicate that they are independent globules separated by eutectic phase.

Figure 2:
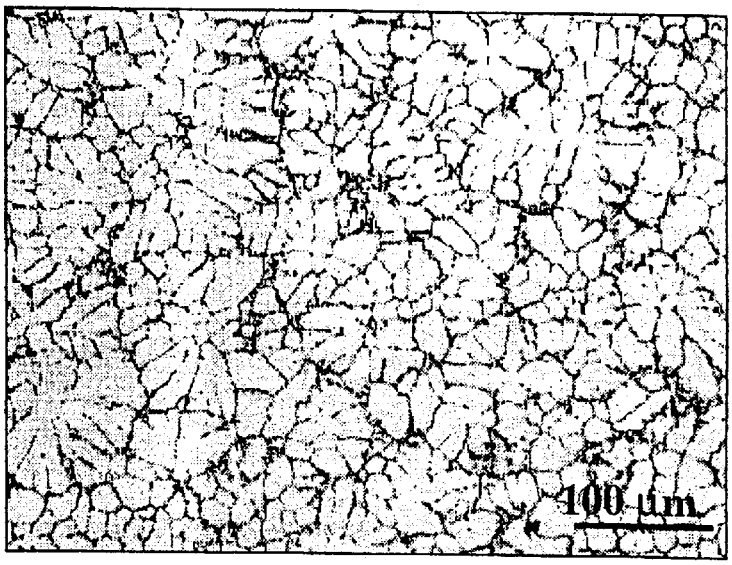
FIG. 2 shows a photomicrograph of the microstructure obtained by casting aluminum alloy 2618 from a temperature of 50–60° C. above its liquidus temperature.

FIG. 2 shows a photomicrograph of the as-cast structure obtained using similar apparatus but with casting conducted in the conventional manner in which the melt is cast at a temperature of about 50–60° C. above the liquidus temperature. As can be seen from FIG. 2, a dendritic structure is obtained. This structure is not especially suitable for thixoforming.

The microstructure obtained in 2618 alloy has been reproduced in other wrought and casting alloys, such as 2011 (wrought alloy), 7075 (wrought alloy), and A356 (casting alloy) by casting those alloys from their liquidus temperature.

A total of over 54 experiments were carried out to produce materials of various compositions (i.e. commercial compositions of aluminum alloys 2618,2011,7075 and A356) and microstructures (i.e. as-liquidus-cast, as conventional-cast, as-reheated and as-formed). The microstructure of the materials was examined by optical microscopy and image analysis to ascertain the non-dendritic structure. The thixotropic structure was further confirmed by three dimensional modelling and by measuring the orientations of adjacent grains by using scanning electron microscopy and electron back scattered pattern.

The liquidus-cast 2618 slugs were reheated to semisolid temperature range to have about 60% solid and 40% liquid. The slugs were then either cut through using a knife edge or compressed manually by a flat ceramic tool to show the ability of the material to deform easily. (It was impossible to do so with the conventionally cast material). This shows the suitability of the material for use in thixoforming.

Figure 3:
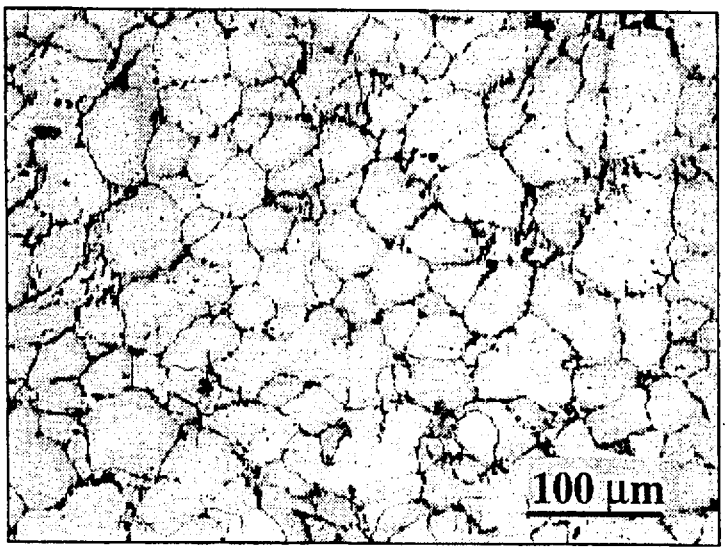
FIG. 3 shows a photomicrograph of the metal casting shown in FIG. 1 after the casting has been heated to a temperature between the solidus and liquidus temperature.
Figure 4:
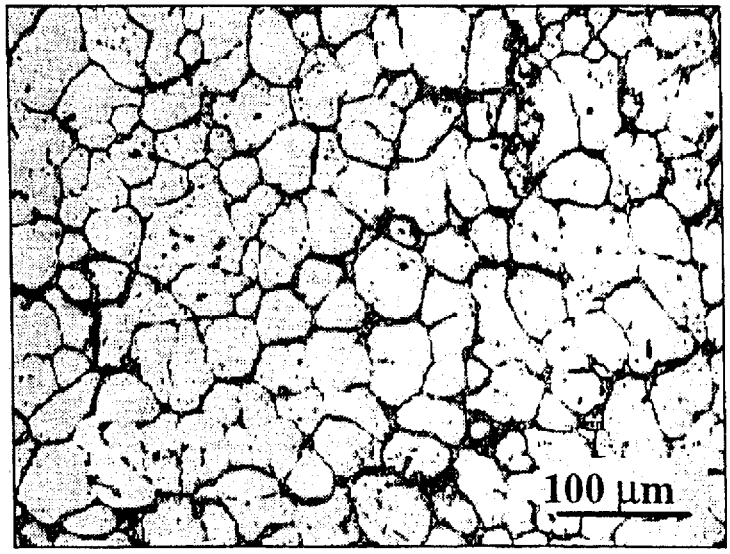
FIG. 4 shows a photomicrograph of an article formed by thixoforming the material shown in FIG. 3.

In further experiments, the as-liquidus-cast alloy was subsequently reheated to the desired processing temperature in the solid-liquid region followed by thixoforrning into near-net-shape. The microstructure after reheating of a liquidus cast 2618 alloy is shown in FIG. 3; the fine, non-dendritic structure is retained. The microstructure after thixoforming is shown in FIG. 4; the flow is homogeneous.

Thixoforming Examples

In order to further demonstrate the present invention a number of further experiments were conducted in which solidified metal, obtained from casting molten metal at substantially the liquidus temperature to produce a billet of appropriate dimensions, was brought to the semi-solid regime using an induction heating furnace. The billet was held in the induction heating furnace for a time of 2–3 minutes. The resulting semi-solid billet was then shaped under desired forming conditions using a commercial 500 tonne hydraulic press.

In the thixoforming process used in the following Examples, the billet of thixotropic material is introduced into open dies which subsequently close to form the article, and then open again for the ejection of the finished component. This is opposed to and believed to be unique over known thixoforming processes that use forming processes that are akin to die casting in which a thixotropic material is injected into a set of closed dies through a shot sleeve. However, the open die thixoforming process must not be confused with conventional open die solid forging. In fact, the open die thixoforming process of the present practice is more akin to conventional closed die solid forging, in the same way in which thixocasting can be likened to liquid die casting, for example.

Figure 5:
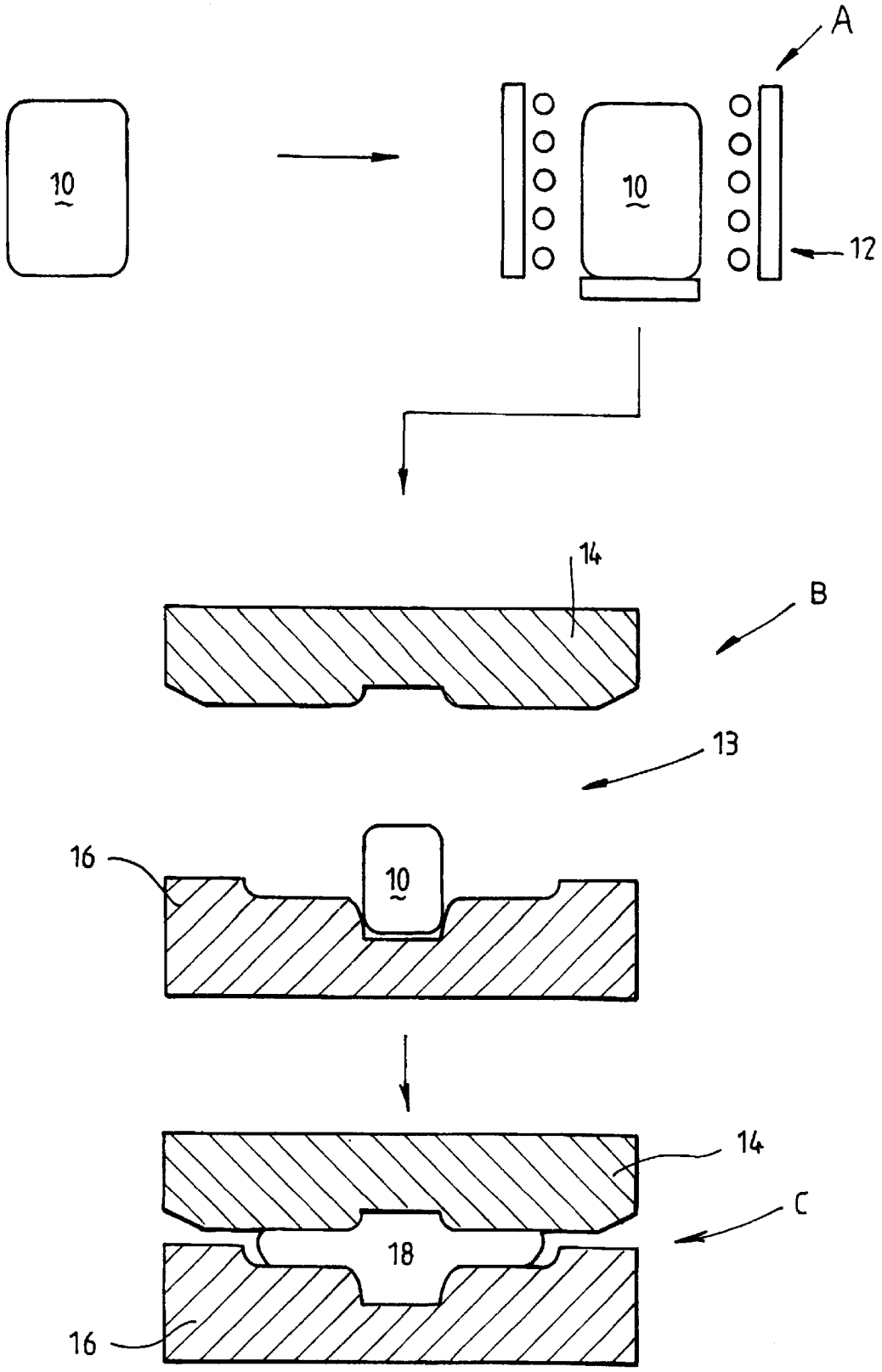
FIG. 5 shows a schematic diagram of the thixoforming process used in the present invention.

A typical thixoforming cycle as practiced in the present "open die" approach used in the following Examples and shown schematically in FIG. 5 consists of the following steps: (a) billet reheating, in which billet 10 is supplied to induction heating means 12 and heated to a temperature between the solidus and liquidus temperature to produce a thixotropic material. The thixotropic material is preferably self-supporting (b) billet transfer to open dies, 14, 16 (c) forging stroke initiation and forming, and (d) removal of thixoformed component (not shown). Just as a billet, 10 being reheated to a desired semisolid condition, is ready for transfer to the press, 13 the dies 14, 16 open and the billet 10 is removed from an induction heating coil case 12 and seated in the lower die 16. Once the semisolid (thixotropic) billet 10 is positioned, the press operator initiates the forming cycle (defined by the pre-set forming speed, and final forming load) and the billet 10 is thixoformed upon the approach of the top die 14 and its closure onto the lower die 16. During the forming cycle the thixotropic billet 10 is forced to follow the contours of the dies. The dies stay closed for a predetermined time (dwell time). After the elapse of the dwell time the dies open, the thixoforged article 18 is removed by the press operator, and the dies are closed again so that they are maintained at the correct temperature by a gas ring heater. A typical forming cycle, defined by the time from semisolid billet removal from the heating coil, and including its placement in the press and forming by die closure, is less than 20 seconds.

Figure 6:
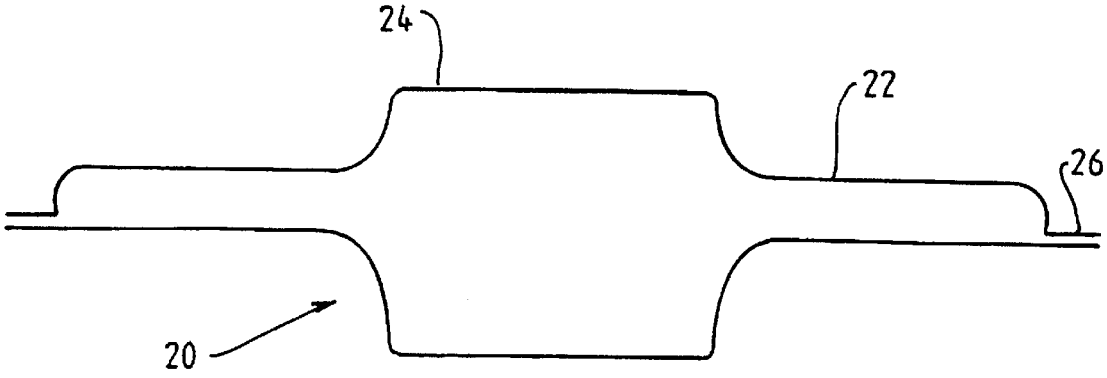
FIG. 6 shows a cross-sectional, side elevation of a clutch hub formed in accordance with the present invention.

Using the above process, the commercially available aluminum alloy 2618 was thixoformed under various forming conditions (to be discussed hereunder). The billet of solidified metal was obtained by casting molten metal from the liquidus temperature. The demonstration article thixoformed in the Examples is an automotive clutch hub component 20 as shown in FIG. 6. This component has previously been manufactured from steel by conventional forging methods. In conventional forging methods for producing this component, the component was made with the use of two die sets, blocker and finisher die and was subject to finishing/machining operations. When the article was produced by thixoforming in accordance with the present invention, only the finisher die was required to arrive at a near net shape compound in a single step.

The starting thixotropic material provided to die 14 is a self-supporting cylindrical billet having a ratio of height to diameter (H/D) of about 1.4. The thixoforming step used to produce the clutch hub shown in FIG. 6 reduces the height of the billet to about 40% of the original height in the central region of the hub and to about 11% of the original height in the peripheral flange portion of the hub. The final diameter of the hub is approximately 2.4 times the diameter of the cylindrical billet of thixotropic material.

It can be seen from FIG. 6 that while the cross-section of the clutch hub 20 is a relatively simple symmetrical shape (essentially a flat plate 22 extending radially from a centrally located hub region 24 of a wider cross-section), the detail of the flange periphery 26 shows that good flow characteristics are required to faithfully reproduce this particular feature of the article.

The clutch hub 20 was successfully thixoforged from alloy 2618 under a wide range of thixoforming conditions. Process parameters investigated were (a) semisolid condition, ie. fraction of solid phase in the starting billet; (b) die temperature; and (c) forming speed. All of these are related to the ease (or lack thereof) with which an article can be thixoformed. Generally, the lower the fraction of the solid phase and the higher the fraction of the liquid constituent, the less viscous is the semisolid slurry charge and the easier it is to deform. The resistance of a semisolid slurry system to applied force increases steeply with increasing fraction of solid in the material, for the range of fractions solid that can be practically applied in semisolid forging (ie. 0.8> fraction solid >0.5). Die temperature is most often related to surface finish of thixoforgings, where higher die temperatures tend to produce better surface finish and also prevent premature freezing of the semisolid slurry charge on contact with the dies. The forming speed is related to the rate of shearing (deformation) of the semisolid charge, and generally the higher the shearing rate, the lower the resistance of the semisolid slurry system to the applied load. Another obviously important variable is the applied load necessary for the deforming (shaping) of the semisolid charge, and this may be several orders of magnitude less in thixoforming than is required in conventional forging.

In a total of 25 thixoforming trials, clutch hubs were successfully thixoformed at solid fractions in the semi-solid material of 0.8> fraction solid >0.6, at die temperatures from 150–300° C., and forming speeds of 0.1–0.2 m/s. The forming load was 350 tons (well below the press capacity), and it was obvious that a much smaller forming load would suffice. The full forming load was only applied as the final clamping load, which is produced only after the top and bottom dies come in contact and fully close.

The fraction solid of the semisolid charge was varied from low (60% solid) to medium (70% solid) to high (80% solid), and for each fraction solid the forming speed was varied from slow (~0.1 m/s) to medium (0.2 m/s). Low (150° C.) or high (300° C.) die temperature did not at all affect the surface finish quality of the thixoforged clutch hubs. In all of the thixoforging trials fully dense, near net clutch hubs were produced to the shape dictated by the forging dies.

In summary, the solidified metal produced by casting a billet from molten metal at the liquidus temperature showed extremely favourable thixoforming characteristics. A part (automotive clutch hub) which required a substantial change in dimensions from the starting billet to the final article, was easily thixoformed in a single step, to near net shape as dictated by the forging dies, under a wide range of thixoforming conditions. The conditions included quite a high solid fraction of the semisolid charge (80% solid), quite cool forging dies (150° C.), and only moderate forming speeds. Preliminary results from the die filling characteristics during thixoforging show that the load-stroke profile for the deformation of a semisolid charge of alloy 2618 is very close to a profile obtained when the press is run with empty dies (ie. demonstrating minimal flow resistance of the semisolid charge).

Some typical windows of processing conditions for prior art thixoforging (as distinguished from thixocasting) can be compiled from data available in literature. It is claimed that for very simple test components (eg. a flat disc) a component can be thixoforged at fractions of solid of 40–80%, at forming velocities of 0.1–0.5 m/s, and with dies at 150–300° C. For thixocasting, lower fractions of solid (40–60%) and much higher forming speeds (>1 m/s) are necessary. The size of the processing window, or the flexibility of the thixoforming process is in either case heavily dependent on the quality of the thixoforming feedstock, and also on the complexity of the article to be produced. This again highlights the quality of the starting material produced by casting from substantially the liquidus temperature because fully dense and fully formed parts are easily produced at the outer limits of processing conditions as indicated in literature, under which a sound article can normally be produced (ie. high fractions of solid in the starting slurry, low die temperatures, and slow forming speeds). In fact, it would seem from published results that such outer limits as demonstrated here in the thixoforming of the clutch hub, are not usually viable for the production of realistic articles, with the exception of overly simplistic test components as mentioned previously.

Figure 7:
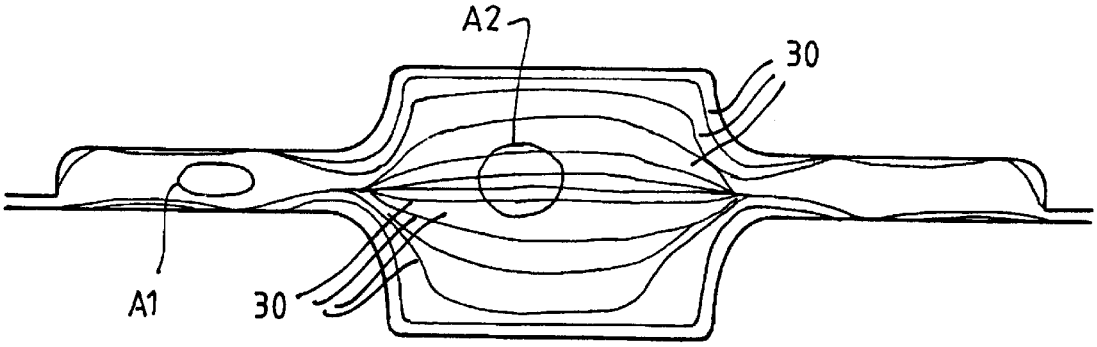
FIG. 7 shows a sectional view of the clutch hub shown in FIG. 6 showing regions of heavy flow and recrystallisation in a clutch hub formed from thixotropic material having a solid content of 75–80% by volume.
Figure 8:
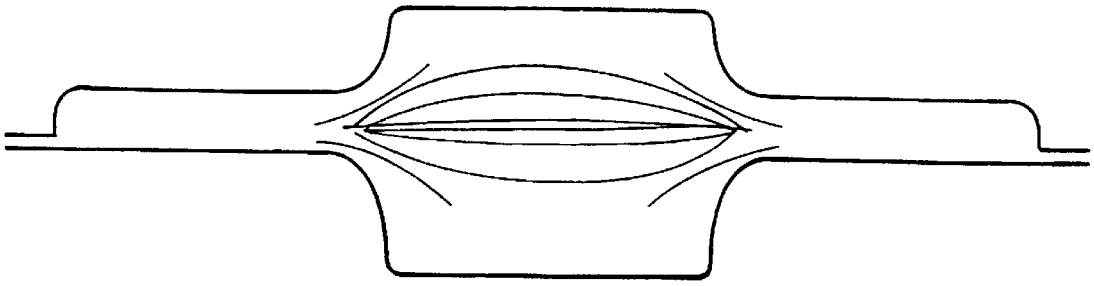
FIG. 8 is a similar figure to FIG. 7 but shows regions of heavy flow and recrystallisation in a clutch hub formed from thixotropic material having a solid content of 60–70% by volume.
Figure 9:
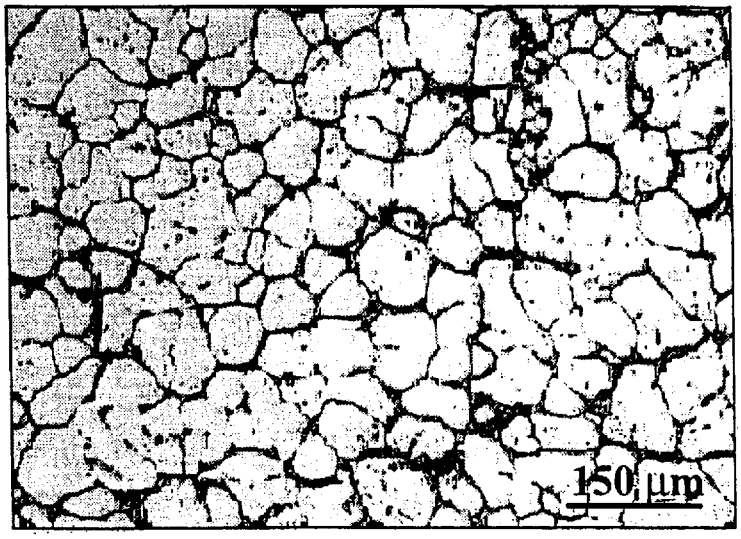
FIG. 9 is a photomicrograph of a sample taken from Region A1 of FIG. 7.
Figure 10:
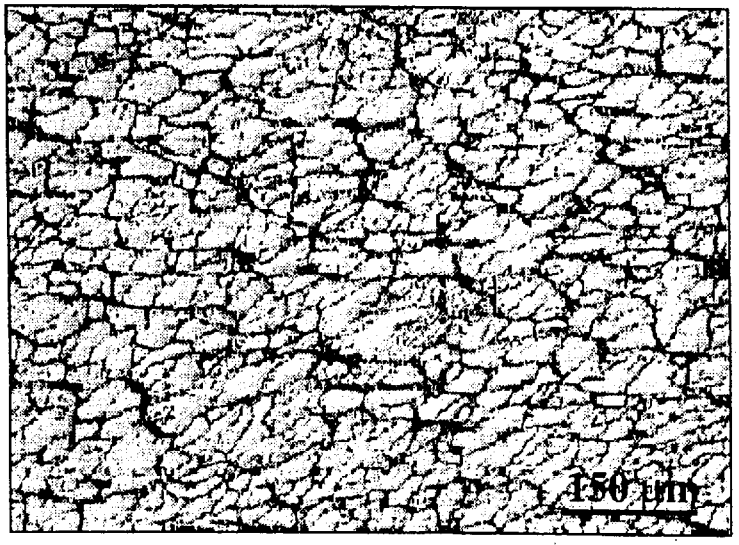
FIG. 10 is a photomicrograph of a sample taken from Region A2 of FIG. 7.

The microstructure of the thixoformed components as (thixo) formed by the present 'open die' thixoforging process is somewhat unusual. The microstructural characteristics across the section of the clutch hub components are summarised in FIGS. 7, 8, 9 and 10. In FIG. 7, the regions of heavy flow and recrystallisation are denoted by flow lines 30. It can be seen from FIGS. 7 and 10 that there are regions where the primary particles (the solid constituent during the forming of semisolid slurry charge) are deformed, indicating the direction of flow of the semisolid charge during forming. It is seen that the grains in the 'flow' region are substantially changed from the globular grains in the original billet. The flow regions are found in the central part of the hub and along the periphery of the flange. In other regions, the primary globular grains remain largely unchanged from how they appear in the original reheated thixotropic billet just prior to forming (see FIG. 9). The extent of the flow regions is found to be dependent on the initial fraction of solid in the starting billet. At higher fraction of solid phase, these regions are found to increase (as shown in FIG. 7), and at lower fraction solid they are reduced (as shown in FIG. 8). The location of the flow regions is the same irrespective of the fraction of solid phase in the starting billet, only their extent changes according to solid fraction, as mentioned previously.

In the view of results presented in thixoforging literature[1,2,3] this is an unexpected result, as there is no mention of flow patterns in thixoforged components. Microstructures presented in literature are akin to those in the unchanged regions without flow in the above example. It can also be postulated on the basis of the above results, that the flow patterns are likely to disappear if the fraction solid in the starting billet is substantially low. It would seem from the results obtained so far that negligible flow pattern or no flow pattern at all could be obtained at fractions solid of less than 60%.

The mechanical properties of clutch hub parts thixoformed from alloy 2618 are quite encouraging and are summarised in Table 2. Tests were carried out strictly according to standard ASTM E8- 96. Tensile properties of thixoforged parts are markedly improved by heat treatment.

TABLE 2

Preliminary results of tensile tests on alloy 2618 thixoforged clutch hubs.

| Heat Treatment | Ultimate Tensile Strength (MPa) | Yield Strength (MPa) | Tensile Elongation (%) |
|---|---|---|---|
| As thixoforged | 300 | 150 | 15 |
| T5 | 312 | 235 | 8 |
| T6 | 397 | 341 | 5 |

The results compare very favourably to those presented for thixoforgings in literature, as shown in Table 3 below, although a direct comparison is not possible since there are no other results concerning alloy 2618. In terms of ultimate tensile and yield strengths the present results are at least as good as but mostly better than those presented for comparable alloys (from the 2000 series) and for comparable heat treatment regimes (T5 or T6). The tensile elongation is also similar to results presented for thixoforgings in literature.

TABLE 3

Properties of Prior-Art, Thixoforged Articles (from Literature)[4]

| Alloy | Heat Treatment | Ultimate Tensile Strength (MPa) | Yield Strength (MPa) | Tensile Elongation (%) |
|---|---|---|---|---|
| 2017 | T4 | 386 | 276 | 8.8 |
| 2219 | T8 | 352 | 310 | 5 |
| 6061 | T6 | 330 | 290 | 8.2 |

It is also very encouraging that the mechanical properties of the present thixoforgings are close to or better than those expected from conventionally (solid) forged components. In the T6 condition conventional alloy 2618 forgings are expected to have ultimate tensile strength of 400 MPa, yield strength of 310 MPa, and tensile elongation of 4%. It should be noted at this stage that the present thixoforging process is not yet fully optimised, and further improvements in properties of thixoforgings are expected.

It is very interesting to note that the excellent tensile properties of the thixoformed clutch hubs can be related to the unique microstructure of the thixoformed parts. Samples were taken from regions of the components that contained the "flow patterns" and from those without. Regions with flow patterns showed the excellent tensile properties mentioned above, where as regions where flow of material was not observed showed somewhat lower (but still impressive) tensile strengths and elongations. It can therefore be concluded that the flow structure is a desirable outcome of the present thixoforming process, which has a positive bearing on the tensile properties of the thixoformed parts.

It will be appreciated that the invention described herein is susceptible to variations and modifications other than those specifically described. It is to be understood that the invention encompasses all such variations and modifications that fall within its spirit and scope.

REFERENCES

1. Hirt, G., Winkelmann, A., Witulski, T. and Ziligen, M., "Third International Conference on Processing of Semi-Solid Alloys and Composites" (ed. Kiuchi, M.) 107–116 (Institute of Industrial Sciences, University of Tokyo, Tokyo, Japan, 1994).
2. Kenney, M. P., et. al., in "Metals Handbook, Volume 15: Casting" (eds. Cubberly, W. h.) 327–338 (ASM International, Ohio, 1988).
3. In "Fourth International Conference on Semi-Solid Processing of Alloys and Composites", Chapter 5a: Industrial Applications: Component Manufacture (eds. Kirkwood, D. H., and Kapranos, P.) 204–256 (The University of Sheffield, England, 1996).
4. In "Metals Handbook, Volume 2: Properties and Selection: Nonferrous Alloys and Pure Metals" (eds. Cubberly, W. H. et.al.) AMS International, Metals Park, Ohio, 1990.

What is claimed is:

1. A process for producing a solid article including the steps of melting a metal alloy to produce a molten metal, reducing the temperature of the molten metal to a temperature of from substantially the liquidus temperature of the molten metal to about 10° C. above the liquid temperature without stirring that causes turbulent flow in the molten metal, casting said molten metal at said temperature, solidifying the cast metal to produce a solidified metal, partially remelting the solidified metal by heating the solidified metal to a temperature between the solidus temperature and the liquidus, temperature to produce a thixotropic material and forming the thixotropic material to a desired shape.

2. A process as claimed in claim 1 wherein said molten metal has temperature of from substantially the liquidus temperature to 2° C. above the liquidus temperature during said casting step.

3. A process as claimed in claim 1 wherein said molten metal has a temperature during said casting step.

4. A process as claimed in claim 1 wherein said molten metal has temperature of from substantially the liquidus temperature to 5° C. above the liquidus temperature during said casting step.

5. A process as claimed in claims 1, 2, 3, or 4 wherein said thixotropic material is self-supporting.

6. A process as claimed in claim 5 wherein the thixotropic material has a solid fraction of at least 0.6 by volume during said forming step.

7. A process as claimed in claim 6 wherein the thixotropic material has a solid fraction of from 0.6 to 0.8 by volume during said forming step.

8. A process as claimed in claim 5 wherein said forming is carried out in a thixoforming apparatus including at least one die and said at least one die has a temperature of less than 300° C.

9. A process as claimed in claim 8 wherein said at least one dies has a temperature of from 150° C. to 300° C.

10. A process as claimed in claim 5 wherein said forming is carried out with a forming speed of up to 0.2 m/s.

11. A process as claimed in claim 10 wherein said forming speed is from 0.1 to 0.2 m/s.

12. A process as claimed in claim 5 wherein said molten metal is cast into a mould.

13. A process as claimed in claim 12 wherein the mould is a steel mould.

14. A process as claimed in claim 12 wherein the mould is at ambient temperature prior to casting of said molten metal.

15. A process as claimed in claim 5 wherein said casting step comprises continuous casting or semi-continuous casting.

16. A process as claimed in claim 5 wherein the step of forming includes providing a forming apparatus having an open lower die, placing said thixotropic material in or on said lower die. causing relative movement between said lower die and upper die such that said lower and upper dies close together to thereby exert force on the thixotropic material and form the thixotropic material to a desired shape, opening said dies and removing the formed material from the forming apparatus.

17. A process as claimed in claim 5 wherein said metal alloy comprises an aluminum alloy, a magnesium alloy, a copper allow, a ferrous alloy, titanium alloy or a superalloy.

18. A process as claimed in claim 17 wherein said metal alloy comprises an aluminum alloy selected from aluminum alloy designation Nos. 2014, 2618, 6061, 6082, 7075.

19. A process as claimed in claim 17 wherein said metal alloy comprises a magnesium alloy selected from magnesium alloy designation Nos. AZ80, AZ910, AZ61A, AM60A.

20. A process as claimed in claim 17 wherein said metal alloy is a nickel superalloy.

21. A process as claimed in claims 1, 2, 3 or 4 wherein said forming is carried out thixoforming apparatus including at least one die and said at least one die has a temperature of less than 300° C.

22. A process as claimed in claims 1, 2, 3 or 4 wherein said forming is carried out with forming speed of up to 0.2 m/s.

23. A process as claimed in claims 1, 2, 3 or 4 wherein said molten metal is cast into a mould.

24. A process as claimed in claim 13 wherein the mould is at ambient temperature prior to casting of said molten metal.

25. A process as claimed in claims 1, 2, 3 or 4 wherein said casting step comprises continuous casting or semi-continuous casting.

26. A process as claimed in claims 1, 2, 3 or 4 wherein the step of forming includes providing a forming apparatus having an open lower die, placing said thixotropic material in or on the lower die, causing relative movement between said lower die and an upper die such that said lower and upper dies close together to thereby exert force on the thixotropic material and form the thixotropic material to a desired shape, opening said dies and removing the formed material from the forming apparatus.

27. A process as claimed in claims 1, 2, 3 or 4 wherein said metal alloy comprises aluminum alloy, a magnesium alloy, a copper alloy, a ferrous alloy, a titanium alloy or a superalloy.

* * * * *

UNITED STATES PATENT AND TRADEMARK OFFICE

CERTIFICATE OF CORRECTION

PATENT NO. : 6,311,759 B1 
DATED : November 6, 2001
INVENTOR(S) : G. Tausig et al.

It is certified that error appears in the above-identified patent and that said Letters Patent is hereby corrected as shown below:

Column 11,
Line 64, “liquid temperature” should read -- liquidus temperature --

Column 12,
Line 3, “liquidus, temperature” should read -- liquidus temperature --
Line 10, “temperature during” should read -- temperature of the liquidus temperature during --
Line 46, “die. causing” should read -- die, causing --
Line 47, “and upper die” should read -- and an upper die --
Line 54, “copper allow,” should read -- copper alloy, --
Line 54, “alloy, titanium alloy” should read -- alloy, a titanium alloy --
Line 65, “out thixoforming” should read -- out in a thixoforming --

Column 13,
Line 2, “with forming speed” should read -- with a forming speed --

Column 14,
Line 2, “on the lower die,” should read -- on said lower die, --

Signed and Sealed this

Twenty-second Day of October, 2002

*Attest:*

*Attesting Officer*

JAMES E. ROGAN
*Director of the United States Patent and Trademark Office*

UNITED STATES PATENT AND TRADEMARK OFFICE

CERTIFICATE OF CORRECTION

PATENT NO. : 6,311,759 B1 
DATED : November 6, 2001
INVENTOR(S) : G. Tausig et al.

It is certified that error appears in the above-identified patent and that said Letters Patent is hereby corrected as shown below:

Column 11,
Line 64, “liquid temperature” should read -- liquidus temperature --

Column 12,
Line 3, “liquidus, temperature” should read -- liquidus temperature --
Line 10, “temperature during” should read -- temperature of the liquidus temperature during --
Line 46, “die. causing” should read -- die, causing --
Line 47, “and upper die” should read -- and an upper die --
Line 54, “copper allow,” should read -- copper alloy, --
Line 54, “alloy, titanium alloy” should read -- alloy, a titanium alloy --
Line 65, “out thixoforming” should read -- out in a thixoforming --

Column 13,
Line 2, “with forming speed” should read -- with a forming speed --

Column 14,
Line 2, “on the lower die,” should read -- on said lower die, --

Signed and Sealed this

Twenty-ninth Day of October, 2002

*Attest:*

*Attesting Officer*

JAMES E. ROGAN
*Director of the United States Patent and Trademark Office*